US007954176B2

(12) United States Patent
Mennes

(10) Patent No.: US 7,954,176 B2
(45) Date of Patent: Jun. 7, 2011

(54) FOOT PROSTHESIS TO ENHANCE THE APPEARANCE OF A DANCER'S FOOT

(76) Inventor: Melania Mennes, Sydney (AU)

( * ) Notice: Subject to any disclaimer, the term of this patent is extended or adjusted under 35 U.S.C. 154(b) by 371 days.

(21) Appl. No.: 11/799,229

(22) Filed: Apr. 30, 2007

(65) Prior Publication Data

US 2007/0260330 A1 Nov. 8, 2007

(30) Foreign Application Priority Data

May 2, 2006 (AU) ..... 2006902254
Nov. 15, 2006 (AU) ..... 2006236016

(51) Int. Cl.
*A41B 11/00* (2006.01)

(52) U.S. Cl. ..... 2/239; 2/240; 2/241; 36/8.3; 36/113

(58) Field of Classification Search ..... 2/239, 240, 2/241, 242, 61; 36/8.3, 113, 71, 72 R, 72 A, 36/72 B; D24/192
See application file for complete search history.

(56) References Cited

U.S. PATENT DOCUMENTS 707,659 A * 8/1902 Ware et al. ..... 2/239
1,518,758 A * 12/1924 Rodee ..... 2/61
1,901,659 A 5/1931 Larack
2,090,573 A 3/1935 D'Alessandro
2,332,252 A 10/1943 Payne
2,334,206 A * 11/1943 Knohl ..... 66/187
4,756,026 A 7/1988 Pierce
5,007,111 A 4/1991 Adams
5,867,838 A * 2/1999 Corry ..... 2/239
6,226,800 B1 * 5/2001 Islar ..... 2/239
6,393,620 B2 * 5/2002 Hatch et al. ..... 2/239
6,415,795 B1 7/2002 Kew
6,691,431 B2 * 2/2004 Farrior ..... 36/8.3
2003/0033729 A1 2/2003 Farrior
2006/0196078 A1 9/2006 Terlizzi et al.

FOREIGN PATENT DOCUMENTS

GB 2 390 530 A 1/2004

* cited by examiner

*Primary Examiner* — Gary L Welch
*Assistant Examiner* — Alissa J Tompkins
(74) *Attorney, Agent, or Firm* — Kilpatrick Townsend & Stockton LLP

(57) ABSTRACT

An instep enhancing prosthesis (19) to be worn by a dancer to enhance the appearance of the dancer's foot (10). The prosthesis (19) includes a flexible sock portion (20) formed of elastic material to which there is attached an instep enhancing prosthetic portion (27) that has an upper surface (28) that is to provide a smooth line extending from adjacent the ankle joint (11) of the dancer to adjacent the dancer's metatarsals to give the appearance of an increased height of the instep of the dancer's foot.

20 Claims, 9 Drawing Sheets

FOOT PROSTHESIS TO ENHANCE THE APPEARANCE OF A DANCER'S FOOT

CROSS REFERENCE TO RELATED APPLICATIONS

This application claims the priority of Australian Patent Application No. 2006236016, dated Nov. 15, 2006 and Australian Provisional Patent Application No. 2006902254, dated May 2, 2006, the disclosures of which are incorporated herein by reference.

TECHNICAL FIELD

The present invention relates to footwear that enhances the appearance of a dancer's foot and leg, and more particularly to enhance the appearance of the dancer's foot by increasing the height of the upper and inside portions of the instep (upper arch) of the user's foot.

BACKGROUND OF THE INVENTION

In ballet it is desirable for the dancer's foot to have an enhanced instep (upper arch) incorporating a smoother line from the shin to the toe.

A foot attachment is described in U.S. Pat. No. 6,691,431, which attachment has the object of enhancing the appearance of a dancer's foot. This previously known device suffers from the disadvantage that it does not provide a smooth line with respect to the dancer's foot, at least partly because the device gives the appearance that the dancer's foot is contracted. Further disadvantages include not easily being held in position, not well hidden by a ballet shoe and causing the dancer's foot to appear contracted. Still further, the device does not extend over the ankle joint, resulting in a distorted foot shape. The device of this US patent will only add to the appearance of the dancer's foot if viewed from a specific angle.

SUMMARY OF THE INVENTION

It is an object of the present invention to overcome or substantially ameliorate at least one of the above disadvantages.

There is disclosed herein a foot prosthesis to enhance the appearance of a dancer's ankle, foot and leg line, the prosthesis including:

a sock portion to enclose at least part of the dancer's foot, the portion being formed of elastic material so that when worn it is urged into contact with the foot to inhibit movement of the prosthesis relative to the foot, the sock portion extending from at least adjacent the metatarsals to behind the heel so as to aid in maintaining the sock portion longitudinally urged into engagement with the user's foot, an upper part to cover the foot instep, and a lower part extending below the sole of the foot and extending from the upper part so as to encompass the foot, the sock portion also having an aperture through which the dancer's ankle is to pass; and an instep enhancing prosthetic portion fixed to the upper part and extending from adjacent the ankle aperture so as to extend from the dancer's ankle to adjacent the dancer's metatarsals.

Preferably, the sock portion has a longitudinally extending inner foot portion and a longitudinally extending outer foot portion, with the pad being located at the inner foot portion.

Preferably, the sock portion has an aperture through which a dancer's heel is to project.

Preferably, the sock portion has a toe part to encompass toes of the dancer's foot.

In a further preferred form, the sock portion includes a forwardly extending part that extends forwardly from the upper part and the lower part to pass between toes of the dancer's foot to expose the dancer's toes.

Preferably, the material is breathable.

Preferably, the material is washable.

Preferably, the prosthetic portion is flexible.

Preferably, the prosthetic portion is formed from a silicon plastics material.

BRIEF DESCRIPTION OF THE DRAWINGS

A preferred form of the present invention will now be described by way of example with reference to the accompanying drawings.

DESCRIPTION OF THE PREFERRED EMBODIMENTS

Figure 1:
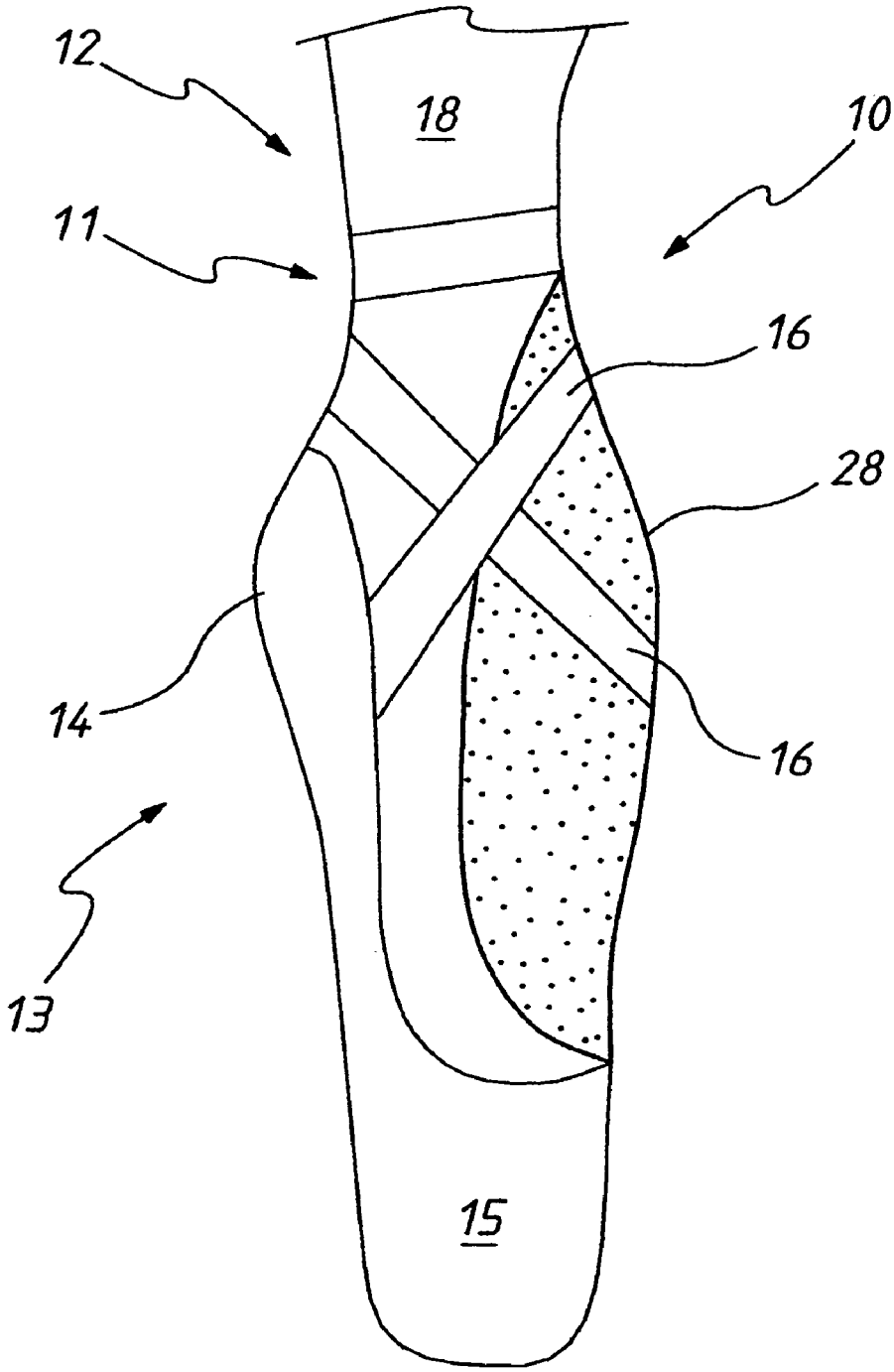
FIG. 1 is a schematic front isometric view of a dancer's foot, with the dancer wearing a ballet shoe and having a foot prosthesis to enhance the appearance of the dancer's foot.
Figure 2:
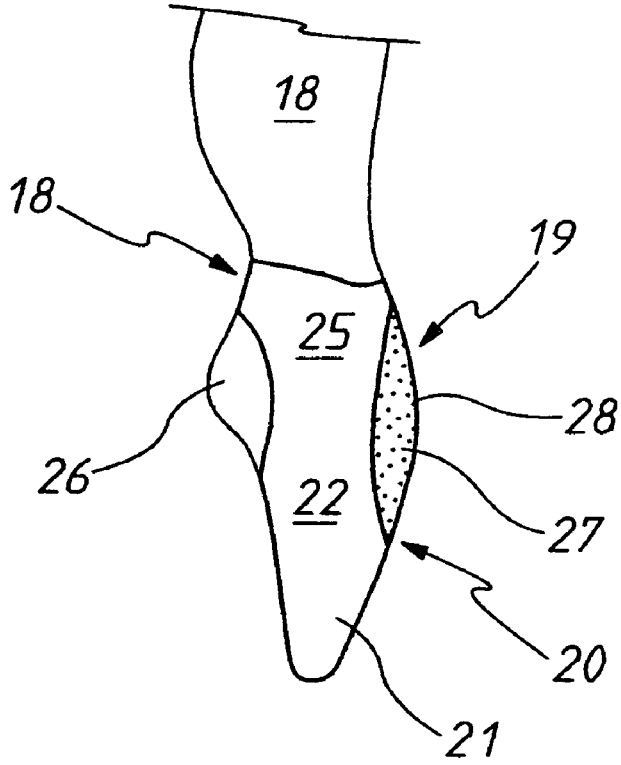
FIG. 2 is a schematic side elevation of the dancer's foot of FIG. 1 with the prosthesis attached thereto.
Figure 3:
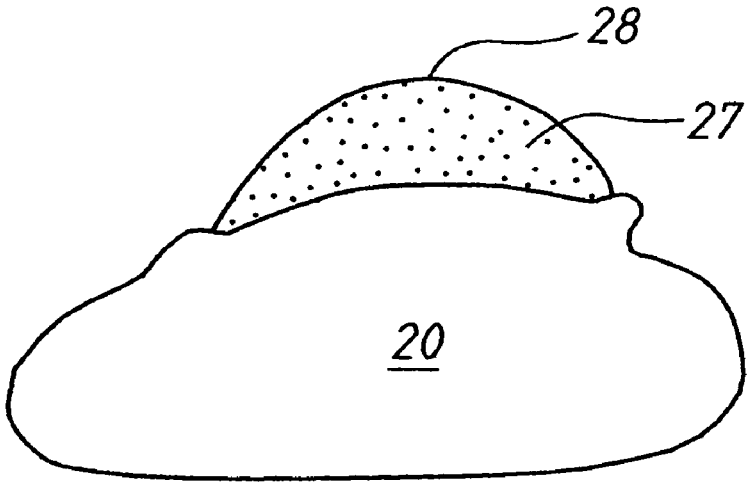
FIG. 3 is a schematic front elevation of the dancer's foot of FIG. 1, with the dancer wearing the prosthesis.
Figure 4:
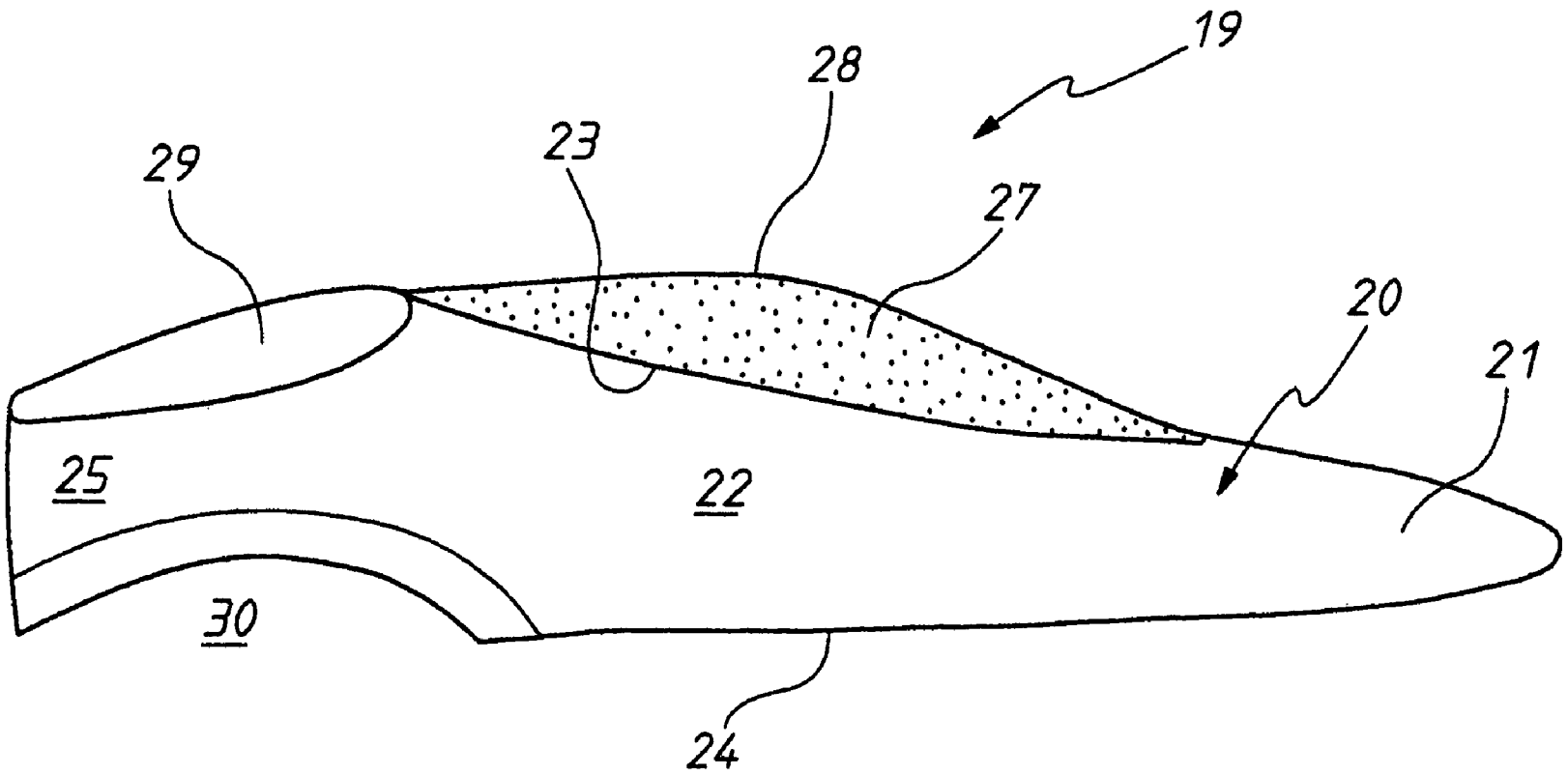
FIG. 4 is a schematic side elevation of the prosthesis of FIGS. 1 to 3.
Figure 5:
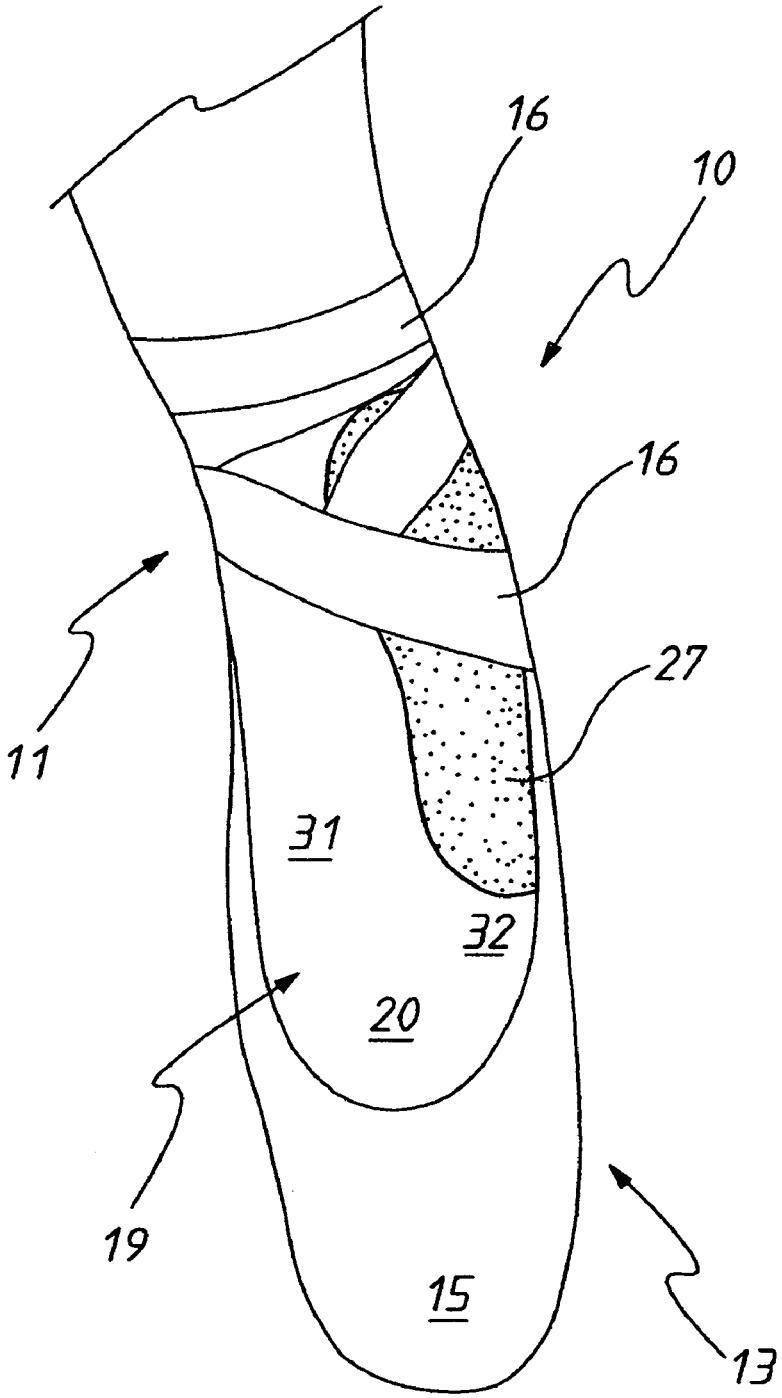
FIG. 5 is a schematic front elevation of the dancer's foot of FIG. 1, with the dancer wearing the above-mentioned foot prosthesis and a ballet shoe.
Figure 6:
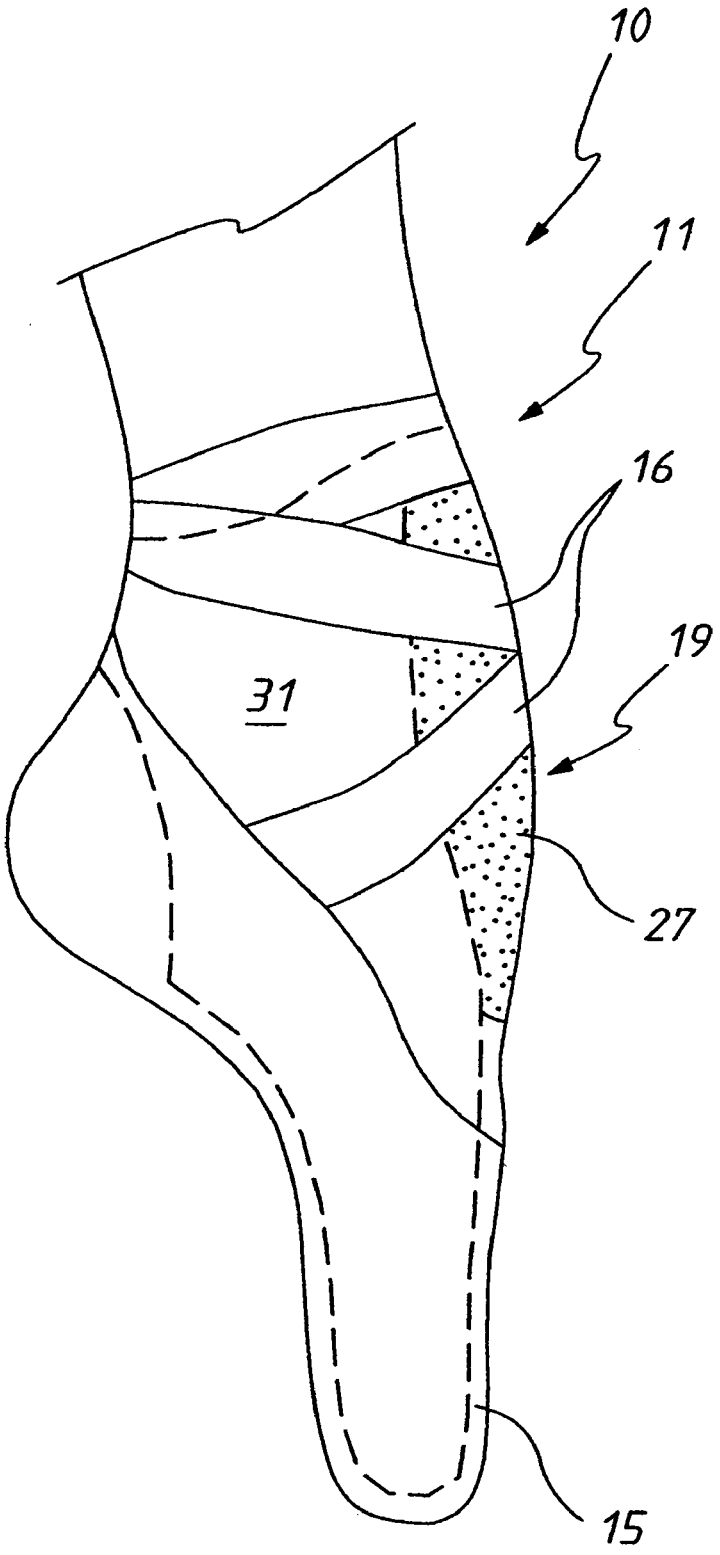
FIG. 6 is a schematic side elevation of the dancer's foot, ballet shoe and prosthesis as shown in FIG. 5.
Figure 7:
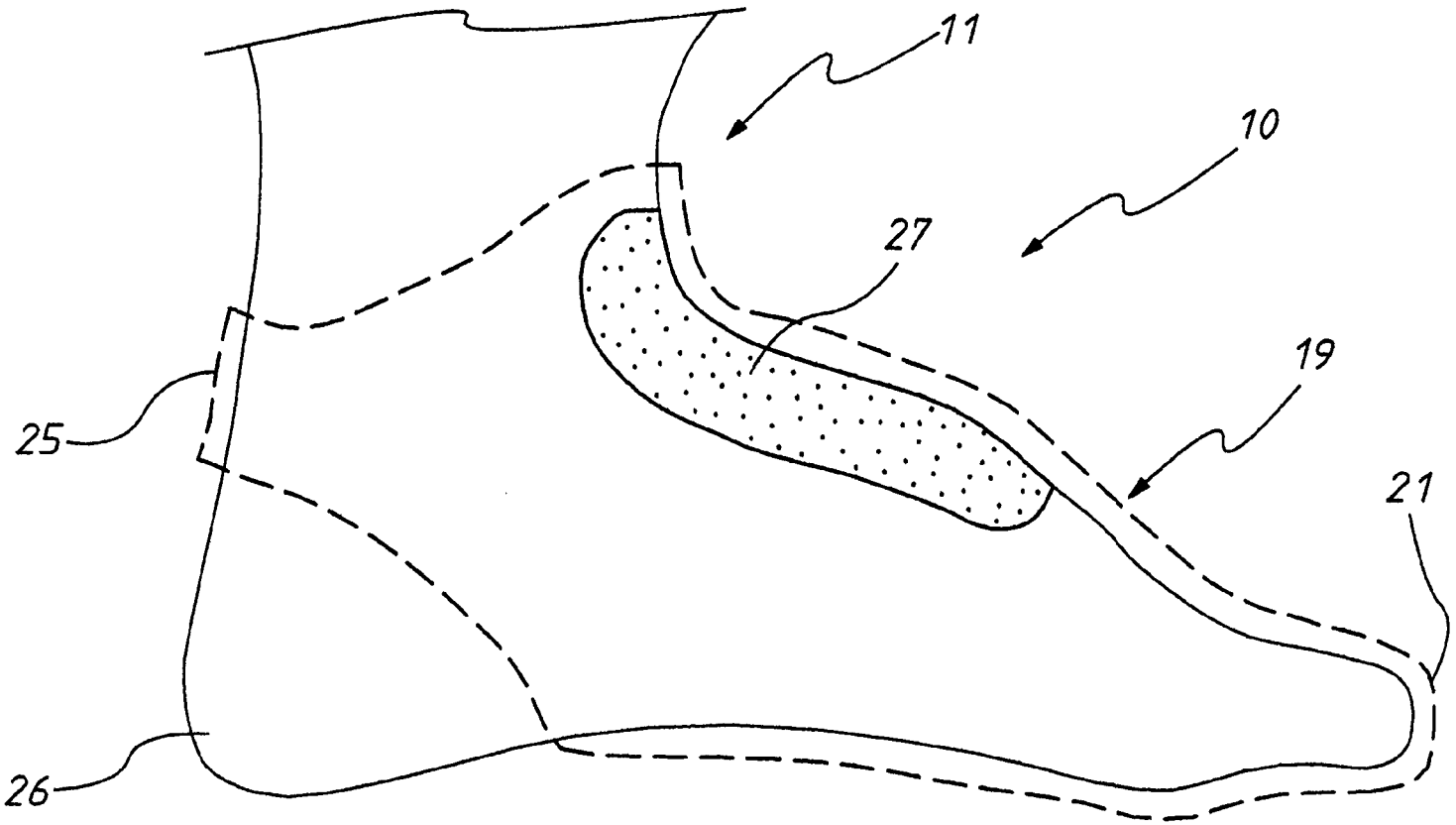
FIG. 7 is a schematic side elevation of the dancer's foot and prosthesis applied thereto.
Figure 8:
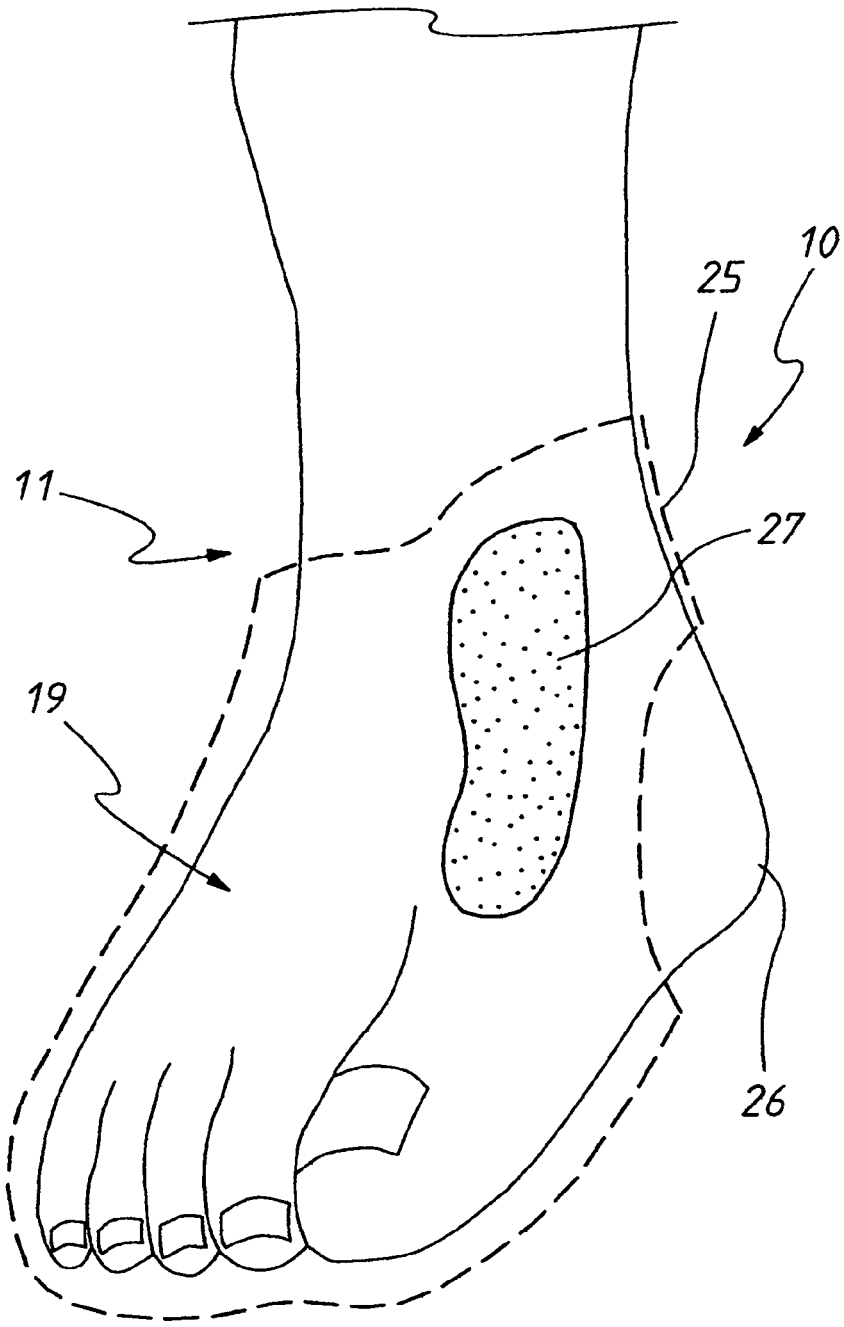
FIG. 8 is a schematic front isometric view of the dancer's foot of FIG. 1 and the prosthesis applied thereto.
Figure 9:
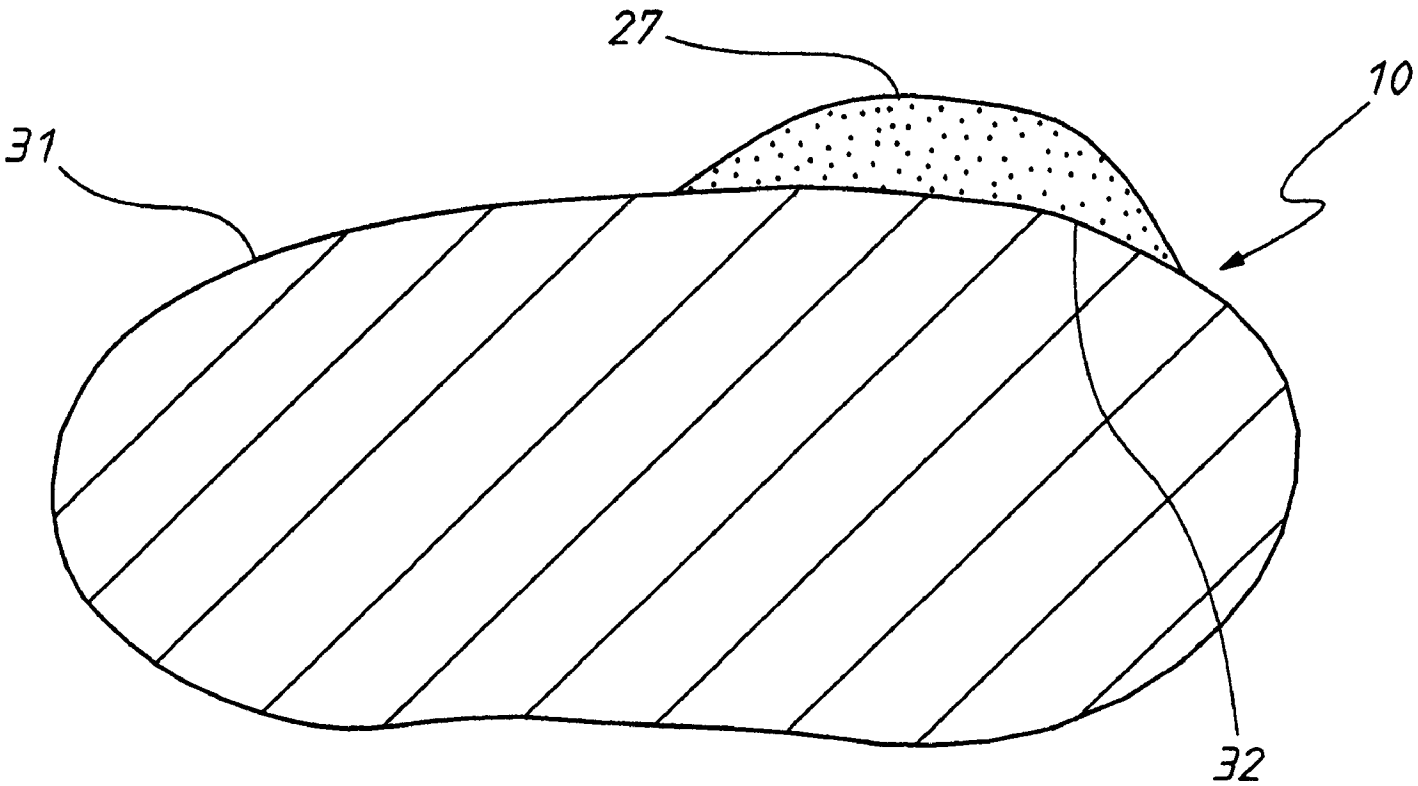
FIG. 9 is a schematic sectioned end elevation of the dancer's foot and prosthesis applied thereto.

In FIGS. 1 to 8 of the accompanying drawings there is schematically depicted the foot 10, ankle joint 11 and lower leg 12 of a ballet dancer. The dancer is wearing a ballet shoe 13 having a sole 14 and upper 15, with tapes 16 securing the shoe 13 to the dancer's foot 10.

Typically the dancer will be wearing a stocking 18 encompassing the foot 10, ankle joint 11 and lower leg portion 12.

To enhance the appearance of the dancer's foot 10, the dancer is wearing prosthesis 19. The prosthesis 19 enhances the appearance of the instep of the dancer's foot by increasing the height of the instep and providing a smoother line extending from the lower leg portion 12 to the user's toes. More particularly the prosthesis 19 includes a sock portion 20 formed of elastic material, such as Lycra Powernet™, so that when worn the sock portion 20 is urged into engagement with the dancer's foot 17. In this embodiment, the sock portion 20 includes a front part 21 that encompasses the dancer's toes, a central part 22 that includes an instep covering part 23 and a lower part 24 that would be positioned below the sole 14 of the foot 10. The central part 22 encompasses the foot. Extending rearwardly from the central part 22 is a rear part 25 that is located behind the heel 26. Accordingly by having parts 21 and 25, the sock portion 20 is elongated longitudinally when worn so as to be urged into contact with the user's foot 10. The central part 22 is expanded when worn so that again it is urged inwardly to engage the user's foot 10.

Fixed to the upper part 23 is an instep enhancing prosthetic portion 27 that has an upper surface 28 that is to provide a smooth line extending from adjacent the ankle joint 11 to adjacent the user's metatarsals to give the appearance of an increased height of the instep of the user's foot 10. The portion 27 has an inner surface to be located adjacent the instep of the foot 10, which inner surface is concave. The upper surface 28 is convex, with the thickness of the portion between the surfaces providing the height increase.

Preferably, the portion 27 is formed of soft, flexible plastics material, and more particularly of silicon plastics material.

Preferably, the sock portion 20 has an ankle aperture 29 through which the ankle joint 11 would project, and a heel aperture 30 through which the dancer's heel 26 projects.

Preferably, the portion 27 has edges that are tapered so that the portion 27 is not easily distinguished from the user's foot 10.

As best seen in FIGS. 5, 7, 8 and 9, the prosthesis 19 is not symmetrically arranged. That is, the sock portion 20 includes a longitudinally extending outer portion 31 and a longitudinally extending inner portion 32. For example in FIG. 5, the dancer's right foot is illustrated. The portion 31 is located on the outside of the foot while the portion part 32 is located on the inside of the foot adjacent the inside of the dancer's left foot. The portion 27 is located at and fixed to the portion 32.

Figure 10:
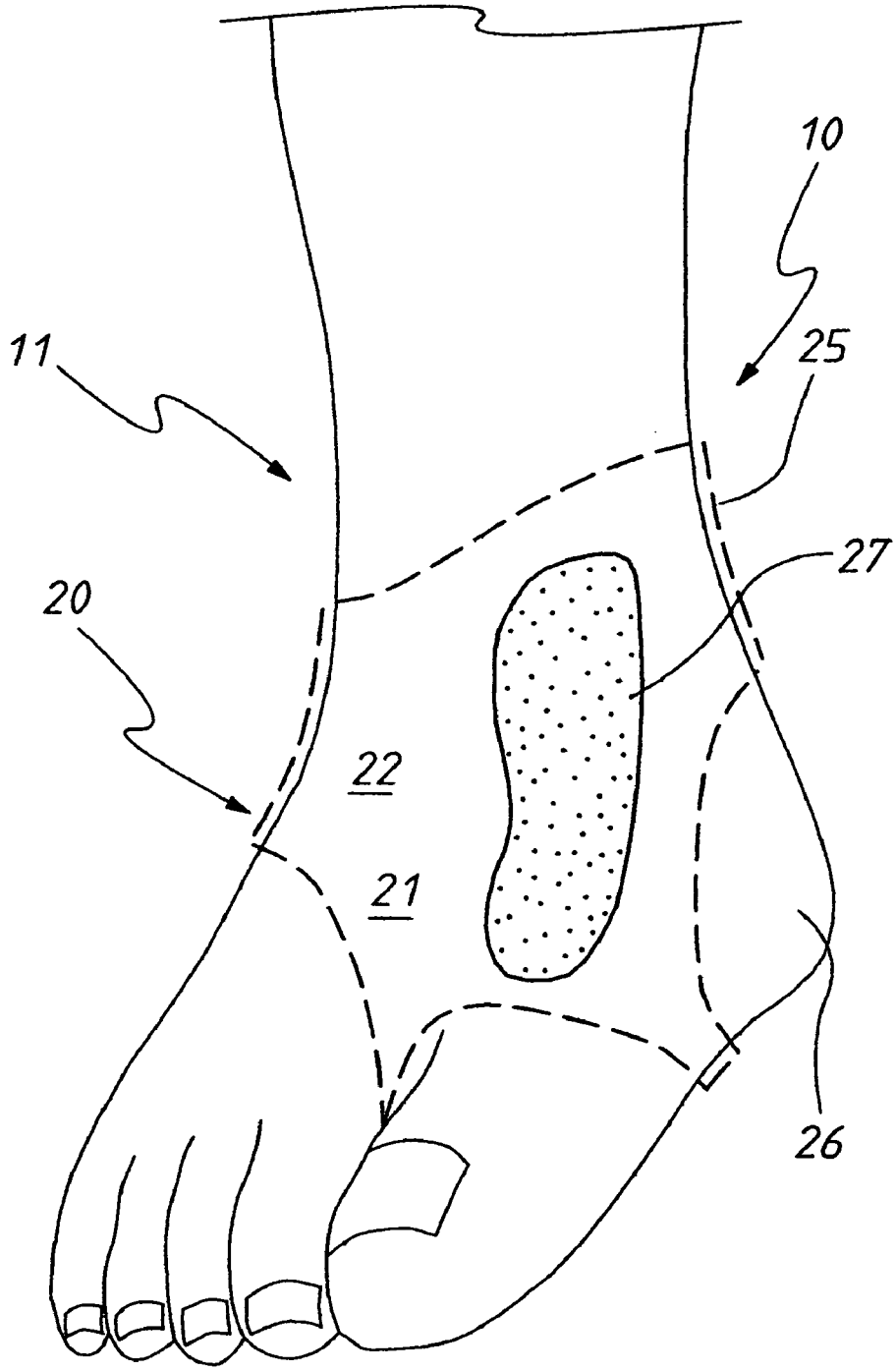
FIG. 10 is a schematic front isometric view of a modification of the prosthesis of FIG. 1, applied to a dancer's foot.

In FIG. 10 there is schematically depicted a modification of the prosthesis 19. In this embodiment the front part 32 passes between adjacent toes of the dancer's foot so as to be a "thong" configuration. Accordingly the dancer's toes are exposed. Typically the prosthesis 19 of FIG. 10 would be used by a dancer that is dancing without footwear.

Preferably, the portion 27 is molded to fit the particular configuration of the wearer's foot, and is molded to suit the left foot or the right foot of the dancer. The sock portion 20 is shaped to inhibit wrinkling at the ankle joint.

When the above-mentioned prosthesis 19 is worn with a shoe 13 and stockings, the prosthesis 19 appears as part of the dancer's foot 10 and adds considerably to the aesthetics of the dancer's foot, irrespective of view point.

The invention claimed is:

1. A foot prosthesis to enhance appearance of a dancer's ankle, foot and leg line, the prosthesis terminating with an end ankle aperture and including:

a sock portion to enclose at least part of the dancer's foot, the portion being formed of elastic material so that when worn it is urged into contact with the foot to inhibit movement of the prosthesis relative to the foot, the sock portion extending from at least adjacent the metatarsals to behind the heel so as to aid in maintaining the sock portion longitudinally urged into engagement with the user's foot, an upper part to cover the foot instep, and a lower part extending below the sole of the foot and extending from the upper part so as to encompass the foot, said sock portion also having the ankle aperture through which the dancer's ankle is to pass; and an instep enhancing prosthetic portion fixed to said upper part and extending from adjacent the said ankle aperture so as to extend from the dancer's ankle to adjacent the dancer's metatarsals; and wherein the sock portion has a longitudinally extending inner foot portion and a longitudinally extending outer foot portion, with said instep enhancing prosthetic portion being placed asymmetrical with respect to a substantially central longitude of the upper part so as to be located at the inner foot portion.

2. The foot prosthesis of claim 1, wherein said sock portion has an aperture through which a dancer's heel is to project.

3. The foot prosthesis of claim 2, wherein said sock portion has a toe part to encompass toes of the dancer's foot.

4. The prosthesis of claim 2, wherein said sock portion includes a forwardly extending part that extends forwardly from the upper part and the lower part to pass between toes of the dancer's foot to expose the dancer's toes.

5. The prosthesis of claim 4, wherein said material is breathable.

6. The prosthesis of claim 5, wherein said material is washable.

7. The prosthesis of claim 6, wherein said prosthetic portion is a flexible pad.

8. The prosthesis of claim 7, wherein said prosthetic portion is formed from a silicon plastics material.

9. The foot prosthesis of claim 1, wherein said sock portion has an aperture through which a dancer's heel is to project.

10. The foot prosthesis of claim 1, wherein said sock portion has a toe part to encompass toes of the dancer's foot.

11. The prosthesis of claim 1, wherein said sock portion includes a forwardly extending part that extends forwardly from the upper part and the lower part to pass between toes of the dancer's foot to expose the dancer's toes.

12. The prosthesis of claim 1, wherein said material is breathable.

13. The prosthesis of claim 1, wherein said material is washable.

14. The prosthesis of claim 1, wherein said prosthetic portion is flexible.

15. The prosthesis of claim 1, wherein said prosthetic portion is formed from a silicon plastics material.

16. The foot prosthesis of claim 1, wherein said sock portion has a toe part to encompass toes of the dancer's foot.

17. The prosthesis of claim 1, wherein said sock portion includes a forwardly extending part that extends forwardly from the upper part and the lower part to pass between toes of the dancer's foot to expose the dancer's toes.

18. The prosthesis of claim 1, wherein said prosthetic portion has a convex outer surface adjacent to the instep.

19. The prosthesis of claim 18, wherein said prosthetic portion has a concave inner surface adjacent to the instep.

20. The prosthesis of claim 19, wherein said prosthetic portion has tapered edges.

* * * * *